US007379692B2

(12) United States Patent
Yamane

(10) Patent No.: US 7,379,692 B2
(45) Date of Patent: May 27, 2008

(54) DEVELOPING APPARATUS, DEVELOPER CONTAINER, AND IMAGE FORMING APPARATUS

(75) Inventor: Naoki Yamane, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 165 days.

(21) Appl. No.: 11/315,126

(22) Filed: Dec. 23, 2005

(65) Prior Publication Data

US 2006/0140681 A1 Jun. 29, 2006

(30) Foreign Application Priority Data

Dec. 28, 2004 (JP) ..... 2004-378588

(51) Int. Cl.
*G03G 15/08* (2006.01)

(52) U.S. Cl. ..... 399/258; 399/120

(58) Field of Classification Search ..... 399/119, 399/120, 258, 262

See application file for complete search history.

(56) References Cited

FOREIGN PATENT DOCUMENTS

JP 09-146366 6/1997

*Primary Examiner*—Hoang Ngo
(74) *Attorney, Agent, or Firm*—Smith, Gambrell & Russell, LLP

(57) ABSTRACT

In a developing apparatus provided with developer container attaching and detaching means that makes a developer container attachable to and detachable from a developing device, inadvertent operation preventing means is provided that disables, when the developing apparatus is detached from an image forming apparatus main body, operation of the developer container attaching and detaching means.

4 Claims, 8 Drawing Sheets

DEVELOPING APPARATUS, DEVELOPER CONTAINER, AND IMAGE FORMING APPARATUS

This application is based on Japanese Patent Application No. 2004-378588 filed on Dec. 28, 2004, the contents of which are hereby incorporated by reference.

BACKGROUND OF THE INVENTION

1. Field of the Invention

The present invention relates to a developing apparatus and a developer container provided in image forming apparatuses such as copiers, facsimiles, and printers, and an image forming apparatus provided therewith.

2. Description of Related Art

There have conventionally been proposed various image forming apparatuses provided with a developing device (hereinafter referred to as a developer unit) that is detachably fitted to an apparatus main body and a developer container (hereinafter referred to as a toner cartridge) that is detachably fitted to the developer unit (see, for example, Japanese Patent Application Laid-Open No. H9-146366).

In such an image forming apparatus, detaching the developer unit with the toner cartridge connected thereto from the apparatus main body has an advantage in preventing spattering and leakage of toner, because this eliminates the trouble of reshielding a portion at which the developer unit and the toner cartridge connect together.

However, the problem here is that, due to the easiness of connecting the developer unit and the toner cartridge together, there is a possibility that the toner cartridge comes off and falls to the ground if the connection release mechanism is touched unconsciously when the developer unit is carried about.

On the other hand, there is a possibility that foreign matters enter a toner feed port, a drive member, and the like when the developer unit, having the toner cartridge completely detached therefrom, is left untouched. In that case, when the developer unit is refitted to the image forming apparatus main body so as to obtain an image, there is a possibility of causing degradation in image quality, abnormal sounds, and what is worse, a breakdown of the apparatus.

In view of the conventionally experienced problems described above, it is an object of the present invention to provide a developing apparatus that can prevent a toner cartridge from inadvertently coming off a developer unit if the developing apparatus is in a state detached from a main body of an image forming apparatus.

SUMMARY OF THE INVENTION

To achieve the above object, according to one aspect of the present invention, in a developing apparatus provided with developer container attaching and detaching means that makes a developer container attachable to and detachable from a developing device, inadvertent operation preventing means is provided that disables operation of the developer container attaching and detaching means if the developing apparatus is in a state detached from an image forming apparatus main body. Note that the inadvertent operation preventing means may be provided either in the developing device or in the developer container.

Preferably, the inadvertent operation preventing means is built as cover means that can be opened and closed and that protects a developing roller rotatably supported inside the developing device. If the developing apparatus is in a state fitted to the image forming apparatus main body, the cover means is in an opened state so as to make the developing roller and the developer container attaching and detaching means exposed to the outside. If the developing apparatus is in a state detached from the image forming apparatus main body, the cover means is in a closed state so as to cover the developing roller and the developer container attaching and detaching means.

According to another aspect of the present invention, in an image forming apparatus provided with the developing apparatus described above, a cover means opening and closing mechanism is provided that causes the cover means to transition from a closed state to an opened state if the developing apparatus is in a state fitted to an image forming apparatus main body, and that causes the cover means to transition from an opened state to a closed state if the developing apparatus is in a state detached from the image forming apparatus main body.

According to the present invention, if the developing apparatus is in a state detached from the apparatus main body with the developer container connected to the developing device for paper jam handling, replacement of expendable supplies, maintenance, or the like, the inadvertent operation preventing means prevents the developer container attaching and detaching means from being easily operated. This makes it possible to prevent troubles such as a developer container falling off.

On the other hand, when the developer container is replaced with a new one, there is no need to detach the developing device from the apparatus main body. By releasing the engagement by operating the developer container attaching and detaching means with the developing apparatus fitted inside the apparatus main body, it is possible to detach the developer container alone.

DETAILED DESCRIPTION OF PREFERRED EMBODIMENTS

Figure 1:
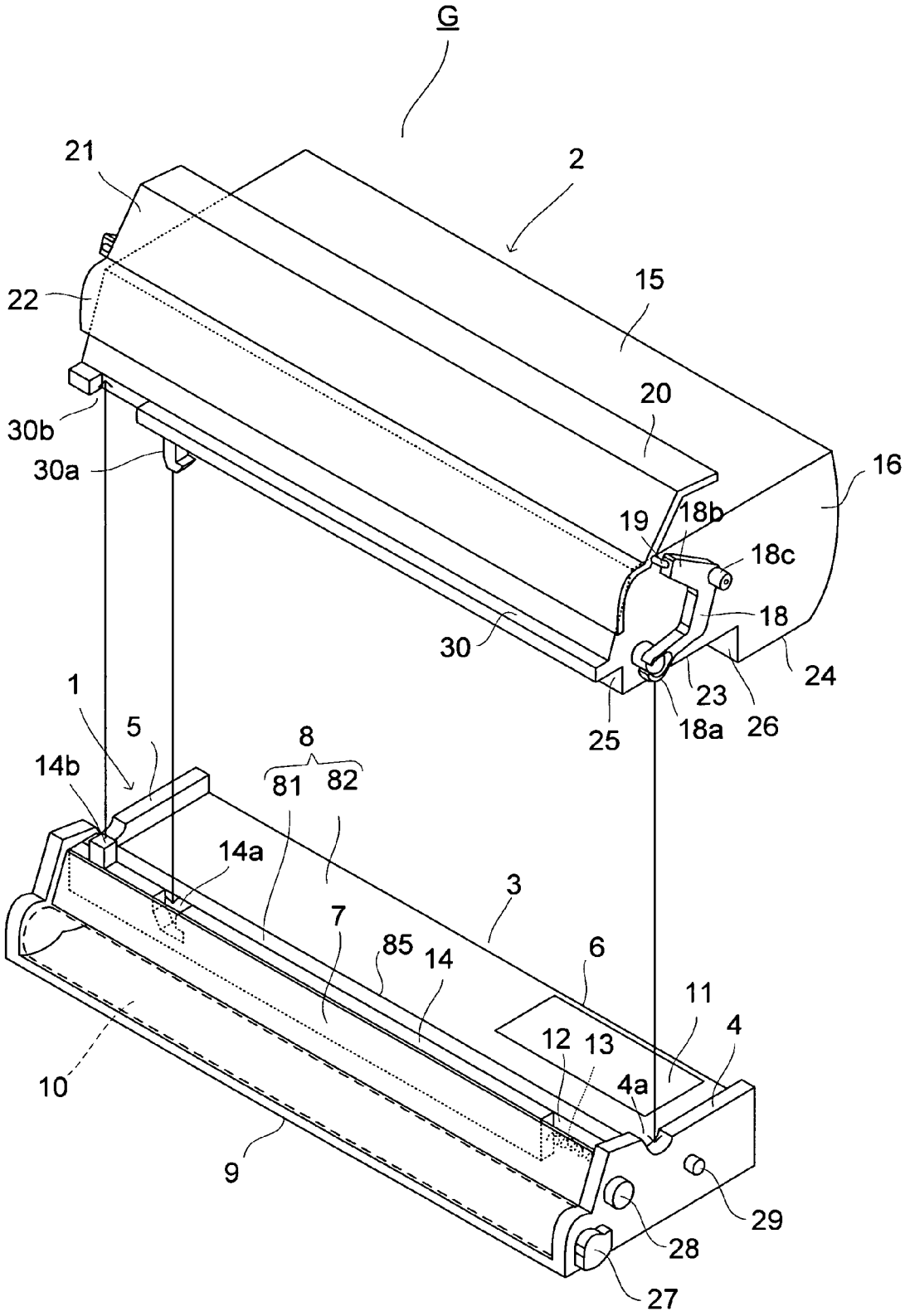
FIG. 1 is a perspective view of the developing apparatus of an embodiment of the present invention with the toner cartridge detached from the developer unit.

Hereinafter, embodiments of the present invention will be described with reference to the accompanying drawings. FIG. 1 is an exploded perspective view of the developing apparatus composed of the developer unit (developing device) and the toner cartridge (developer container). A developing apparatus G is so constructed as to permit a toner cartridge 2 to be detachably fitted to a developer unit 1 in a stacked manner. Here, the construction and operation of the developer unit 1 and the toner cartridge 2 are well known, and therefore no explanation will be given in these respects.

Now, a toner cartridge attaching and detaching mechanism will be described with reference to FIGS. 1 to 5. The developer unit 1 has a casing 3 provided with edge walls 4 and with respect to the direction along the longer sides of the casing 3 (hereinafter referred to as the longer side direction), a right side wall 6, a left side wall 7, a top wall 8, and a bottom wall 9. The top wall 8 is composed of a higher-level top wall 81 and a lower-level top wall 82, with a level difference 85 extending along the boundary therebetween in the longer side direction such that the level is higher than on the left side than on the right side. The higher-level top wall 81 has a groove 12 that is a recessed region having a rectangular cross section and extending in the longer side direction. The groove 12 has a plate-like stopper member (developer container attaching and detaching means) 14 slidably provided therein. The stopper member 14 is biased toward the edge wall 5 side with a coil spring 13 provided between the edge wall 4 and the stopper member 14. The stopper member 14 has, in an upper surface portion thereof, an engaging depression 14*a* to be engaged with a hook-shaped engaging projection 30*a* provided in the toner cartridge 2, and a lever 14*b* so formed as to protrude therefrom for releasing the engagement between the engaging projection 30*a* and the engaging depression 14*a*. The lower-level top wall 82 has, at one end portion thereof, a toner feed port 11 for receiving toner fed from a toner exhaust port (not shown) provided in a lower surface of a toner container 15 of the toner cartridge 2. The left side wall 7 is an inclined plane, below which the surface of a developing roller 10 rotatably supported with the edge walls 4 and 5 is exposed to the outside. The edge walls 4 and 5 each have, in the upper surfaces thereof, an arc-shaped notch for receiving an edge portion 18*a* about which an arm 18 provided in the toner cartridge 2 swings.

On the other hand, the toner cartridge 2 has the toner container 15 filled with toner. The toner container 15 has edge walls 16 and 17 (in FIG. 1, the edge wall 16 alone is shown) each having the arm 18 swingably supported about the edge portion 18*a*. Moreover, a cover member 20 is swingably supported on the extension line of the edge portion 18*b* of the arm 18 via a wire 19 attached to the arm 18. It is to be understood that, although the cover member 20 is made to swing relative to a swinging motion of the arms 18, it can also swing about a point of support of its own independent of the arms 18. The cover member 20 is composed of an upper cover 21 that covers the stopper member 14 and a lower cover 22 that covers the developing roller 10. The cover member 20 swings about a point of support 20*a* formed at two ends thereof with respect to the longer side direction and in the vicinity of the boundary between the upper cover 21 and the lower cover 22 (see FIG. 4).

The toner container 15 has, at a left edge portion thereof, a convex ridge 30 to be placed on the higher-level top wall 81. The convex ridge 30 has, in a lower face thereof, the engaging projection 30*a* to be engaged with the engaging depression 14*a* of the stopper member 14 and a notch 30*b* for moving the lever 14*b* of the stopper member 14 so as to permit a sliding operation thereof.

A lower face of the toner container 15 is composed of a higher-level face 23 and a lower-level face 24. There are formed a level difference 25 extending along the boundary between the lower face of the convex ridge 30 and the higher-level face 23 in the longer side direction, and a level difference 26 extending along the boundary between the higher-level face 23 and the lower-level face 24 in the longer side direction. With this construction, when the higher-level face 23 of the toner container 15 is placed on the lower-level top wall 82 of the casing 3 in such a way that the level difference 25 of the toner container 15 fits in an edge portion formed by the higher-level top wall 81 and the level difference 85 of the casing 3 of the developer unit 1, and that the level difference 26 fits in an edge portion formed by the lower-level top wall 82 and the right side wall 6 of the casing 3, the convex ridge 30 is placed on the higher-level top wall 81 and the stopper member 14, and the lower-level face 24 is located outside of the right side wall 6.

The toner cartridge 2 is fitted to the developer unit 1 as follows. First, the toner cartridge 2 is placed on an appropriate position of the developer unit 1 placed on a flat surface such as a desk. At this time, a taper portion formed at an edge portion of the engaging projection 30*a* of the convex ridge 30 hits an edge of the engaging depression 14*a* of the stopper member 14. When the toner cartridge 2 is further pushed downward from above, the engaging projection 30*a* is inserted into the engaging depression 14*a* while pressing the stopper member 14 against the biasing force of the coil spring 13. Finally, the biasing force of the coil spring 13 is exerted in a position where the engaging projection 30*a* and the engaging depression 14*a* engage together, whereby the engagement between them is achieved. In this way, the toner cartridge 2 is appropriately fitted to the developer unit 1 and is prevented from coming off.

Figure 2:
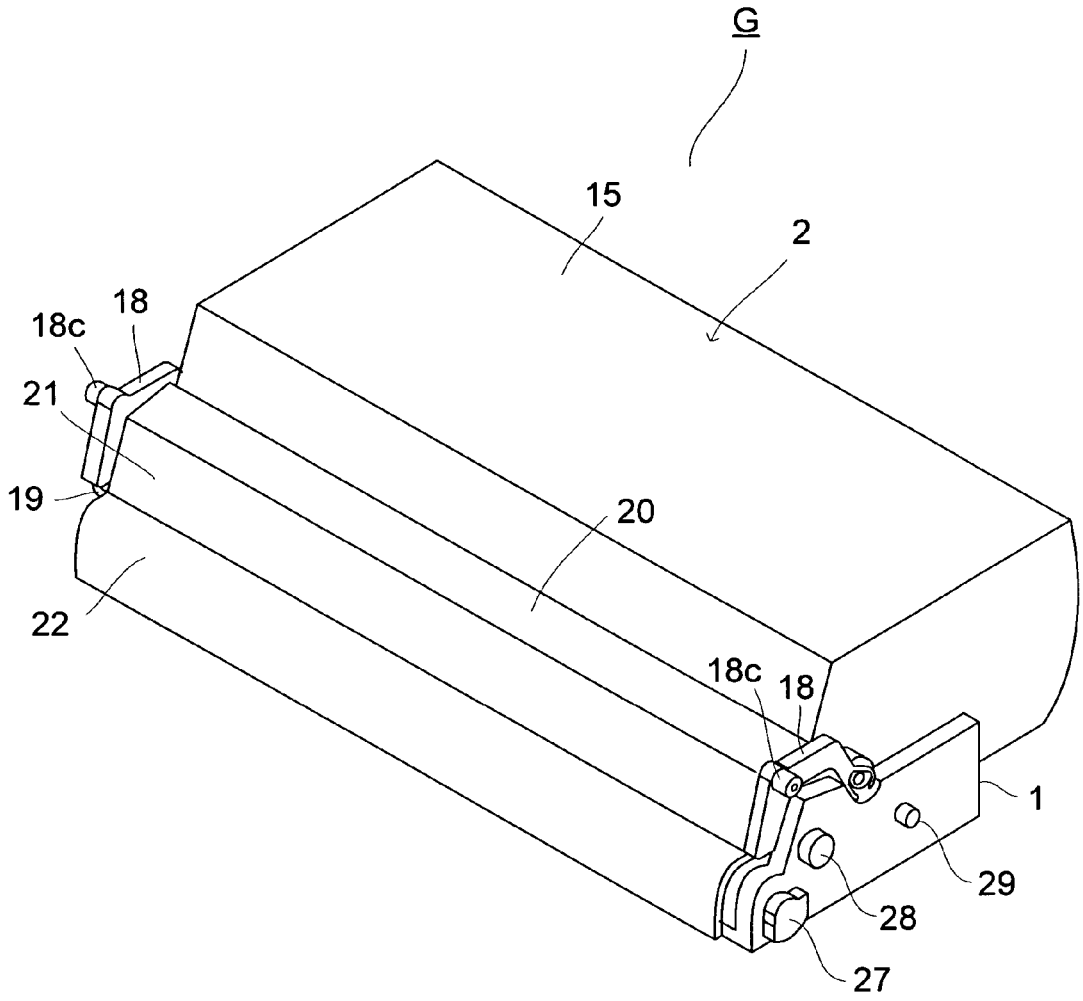
FIG. 2 is a perspective view of the developing apparatus with the toner cartridge fitted to the developer unit and with the cover member closed.
Figure 4:
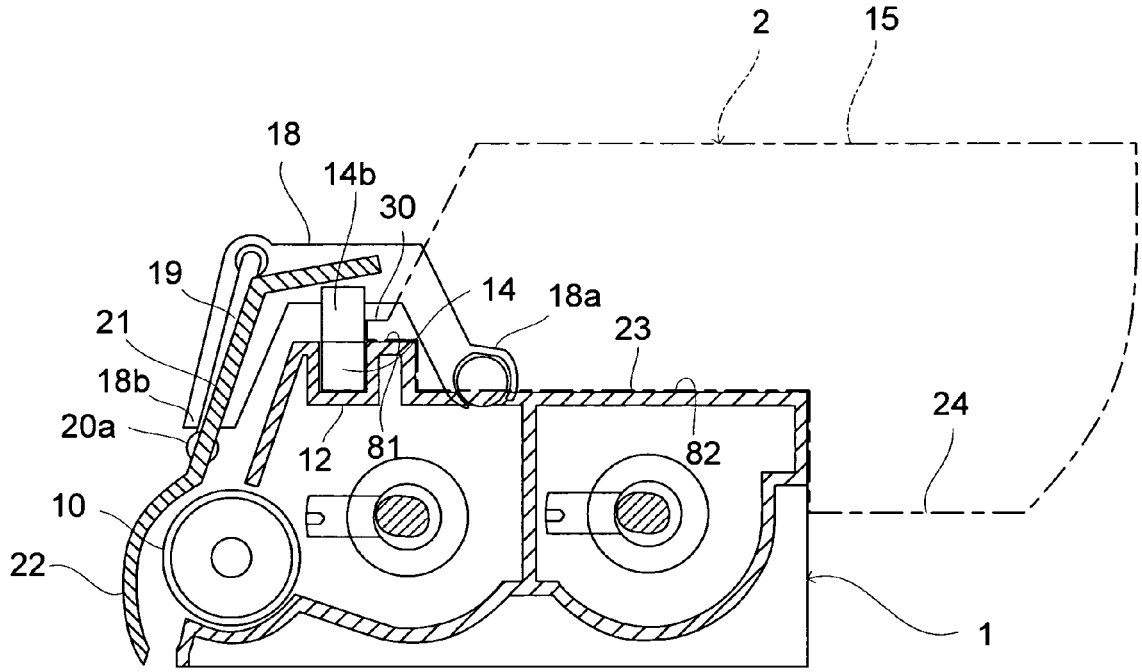
FIG. 4 is a sectional view of FIG. 2.

When the developing apparatus G is not in a state fitted to the main body of the image forming apparatus, the cover member 20 hangs down by its self weight and is in a closed state as shown in FIGS. 2 and 4. In this state, the developing roller 10 is covered and protected with the lower cover 22, and the lever 14*b* is hidden under the upper cover 21, making it impossible to operate the lever 14*b*. This prevents the lever 14*b* from being inadvertently operated when the developer unit 1 is carried about, making it possible to prevent the toner cartridge 2 from coming off.

Figure 3:
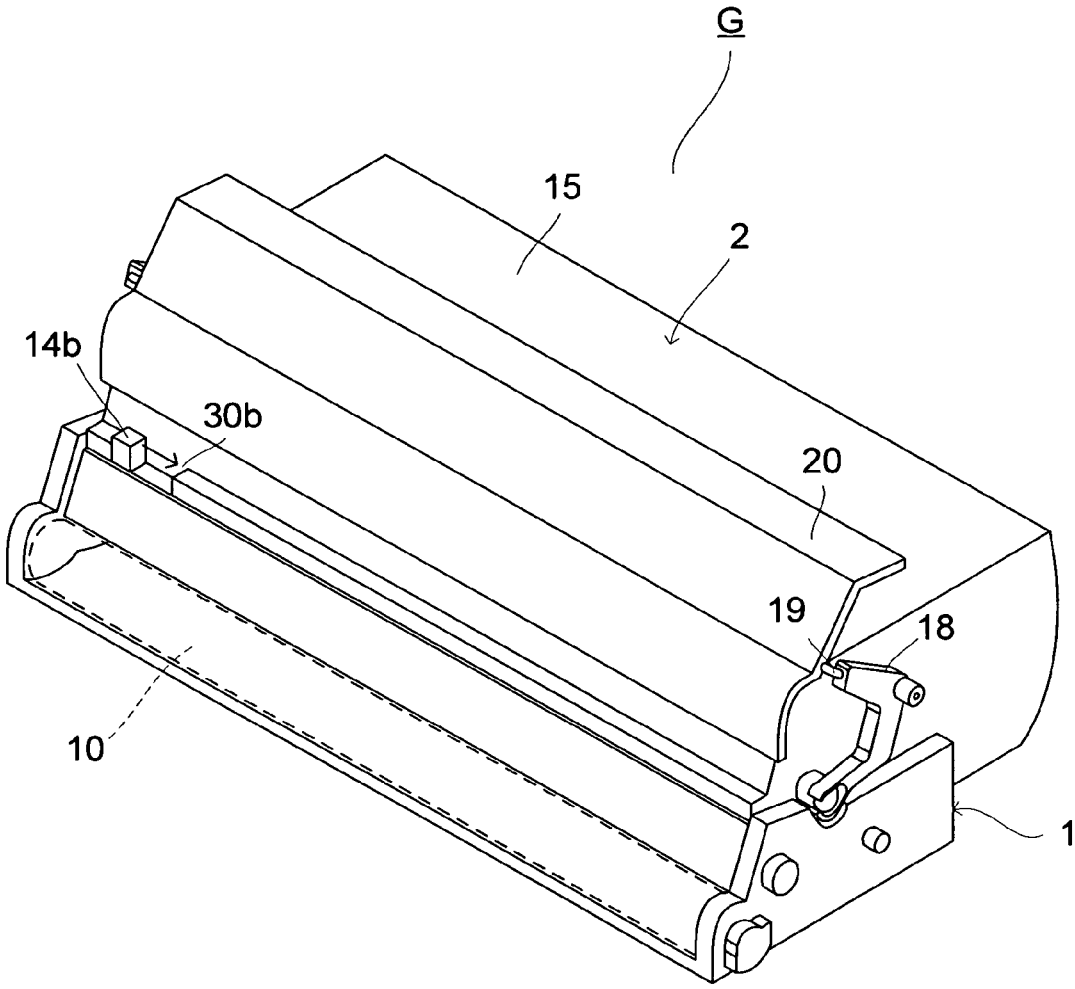
FIG. 3 is a perspective view of the developing apparatus with the toner cartridge fitted to the developer unit and with the cover member opened.
Figure 5:
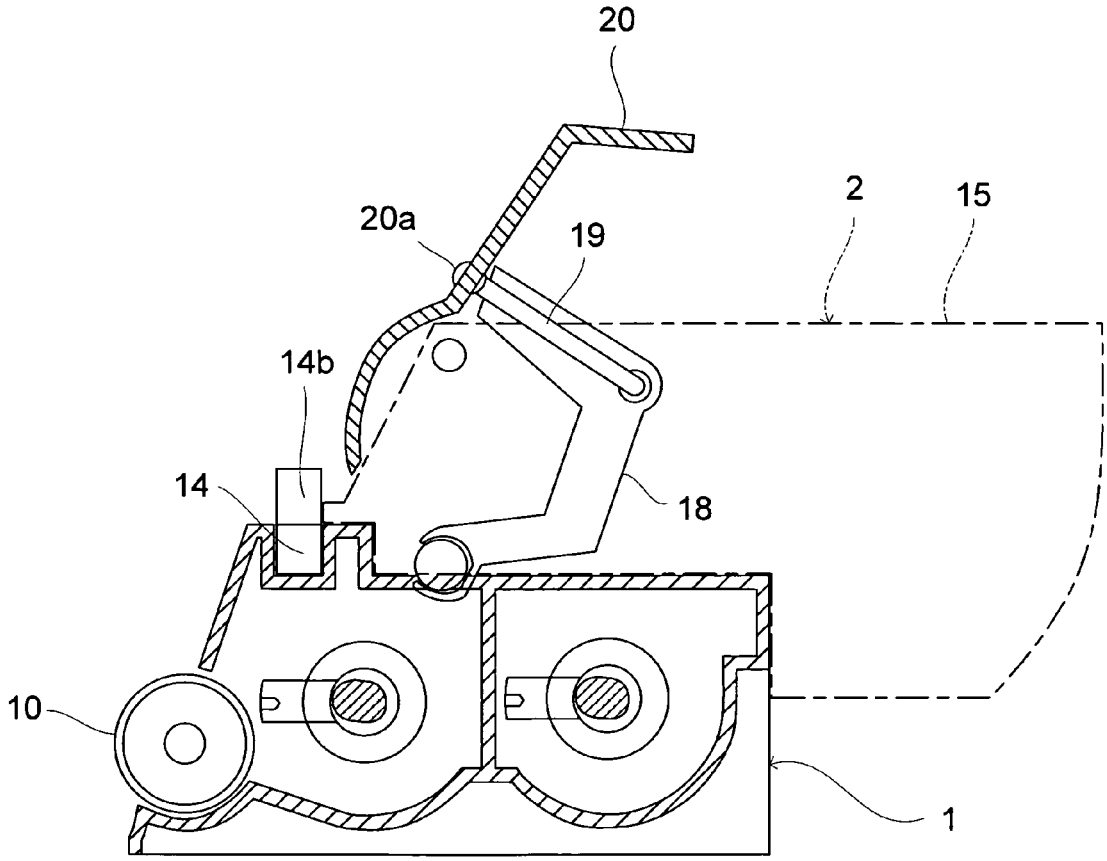
FIG. 5 is a sectional view of FIG. 3.

The toner cartridge 2 is detached from the developer unit 1 as follows. First, the developer unit 1 is placed on a flat surface such as a desk. Then, as shown in FIGS. 3 and 5, the cover member 20 is lifted and retracted to the left above the toner container 15, whereby the developing roller 10 and the lever 14*b* are kept in an opened state in which they are exposed to the outside. In this state, when the lever 14*b* is moved in the direction indicated by an arrow shown in FIG. 3, the engagement between the engaging projection 30*a* (see FIG. 1) and the engaging depression 14*a* (see FIG. 1) is released. This makes it possible to detach the toner cartridge 2 from the developer unit 1 by lifting the toner cartridge 2.

Figure 6:
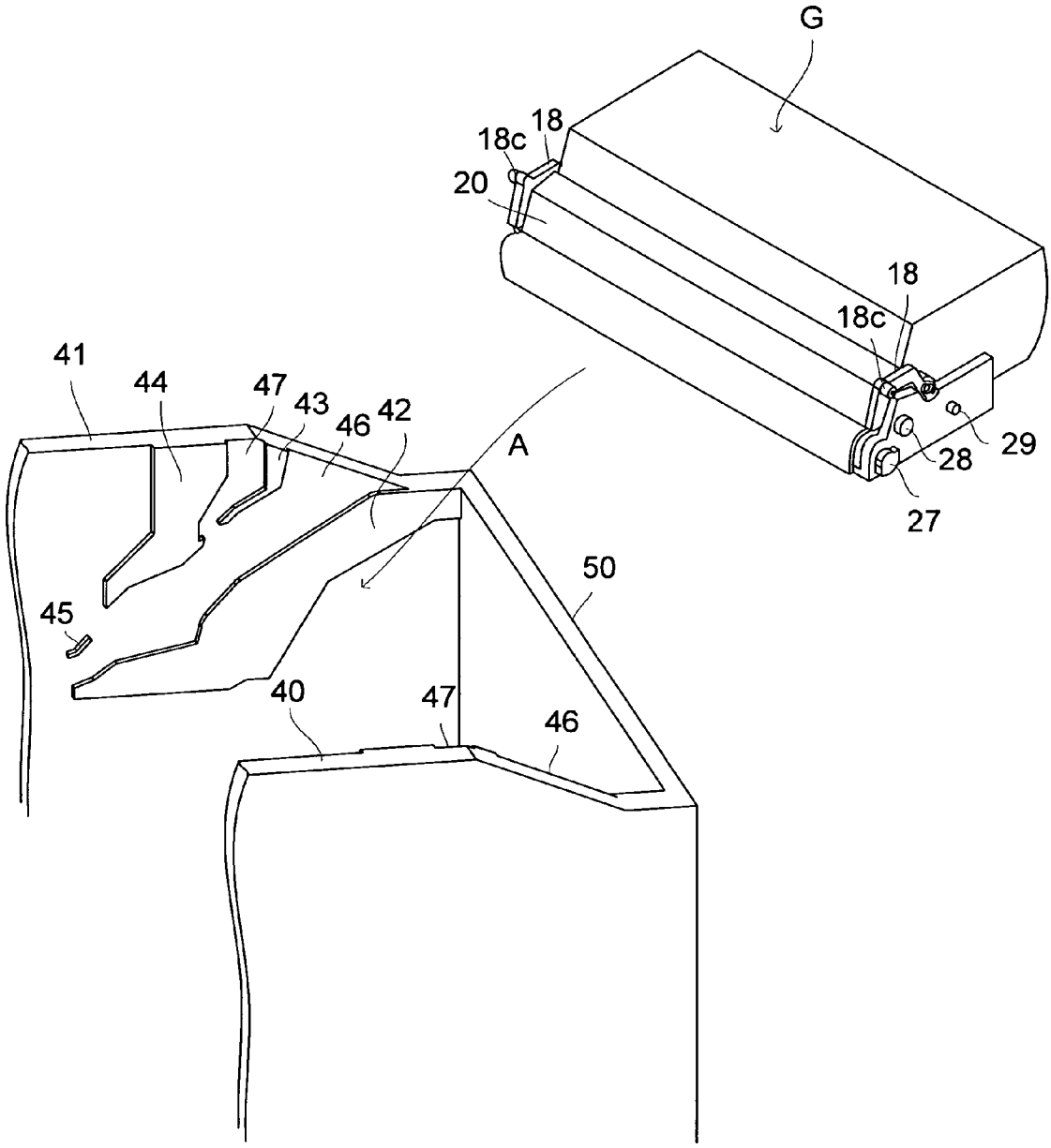
FIG. 6 is a perspective view showing how the developing apparatus is fitted to the image forming apparatus main body.

Next, an attaching and detaching mechanism of the developing apparatus G will be described. As shown in FIG. 6, a main body 50 of the image forming apparatus has a pair of mounting walls 40 and 41 (in FIG. 7, the mounting wall 41 alone is shown) facing with each other with a distance between them approximately corresponding to the length of the longer sides of the developing apparatus G. The mounting walls 40 and 41 each have, on the mutually facing inner surfaces thereof, first and second guide recesses 46 and 47 that guide the developing apparatus G in the attachment/detachment direction thereof and a positioning rib 45 that positions the developer unit 1 in the fitting position. The first guide recess 46 is formed between peninsula-shaped ribs 42 and 43 and between peninsula-shaped ribs 42 and 44, which are one step elevated from the inner surfaces of the mounting walls 40 and 41. The second guide recess 47 is formed between the peninsula-shaped ribs 43 and 44. The peninsula-shaped ribs 42, 43, and 44 and the positioning rib 45 are formed to have the same height, and the elevated surfaces thereof are flush with each other.

On the other hand, as shown in FIG. 2, the edge walls 4 and 5 with respect to the longer side direction of the casing 3 of the developer unit 1 each have, on the outer surfaces thereof, three guide projections 27, 28, and 29 so formed as to project therefrom to be guided by the above-mentioned first guide recess 46 when the developer unit 1 is fitted. Moreover, the arm 18 provided in the toner cartridge 2 has a guide projection 18*c* so formed as to project therefrom to be guided by the above-mentioned second guide recess 47.

Figure 7:
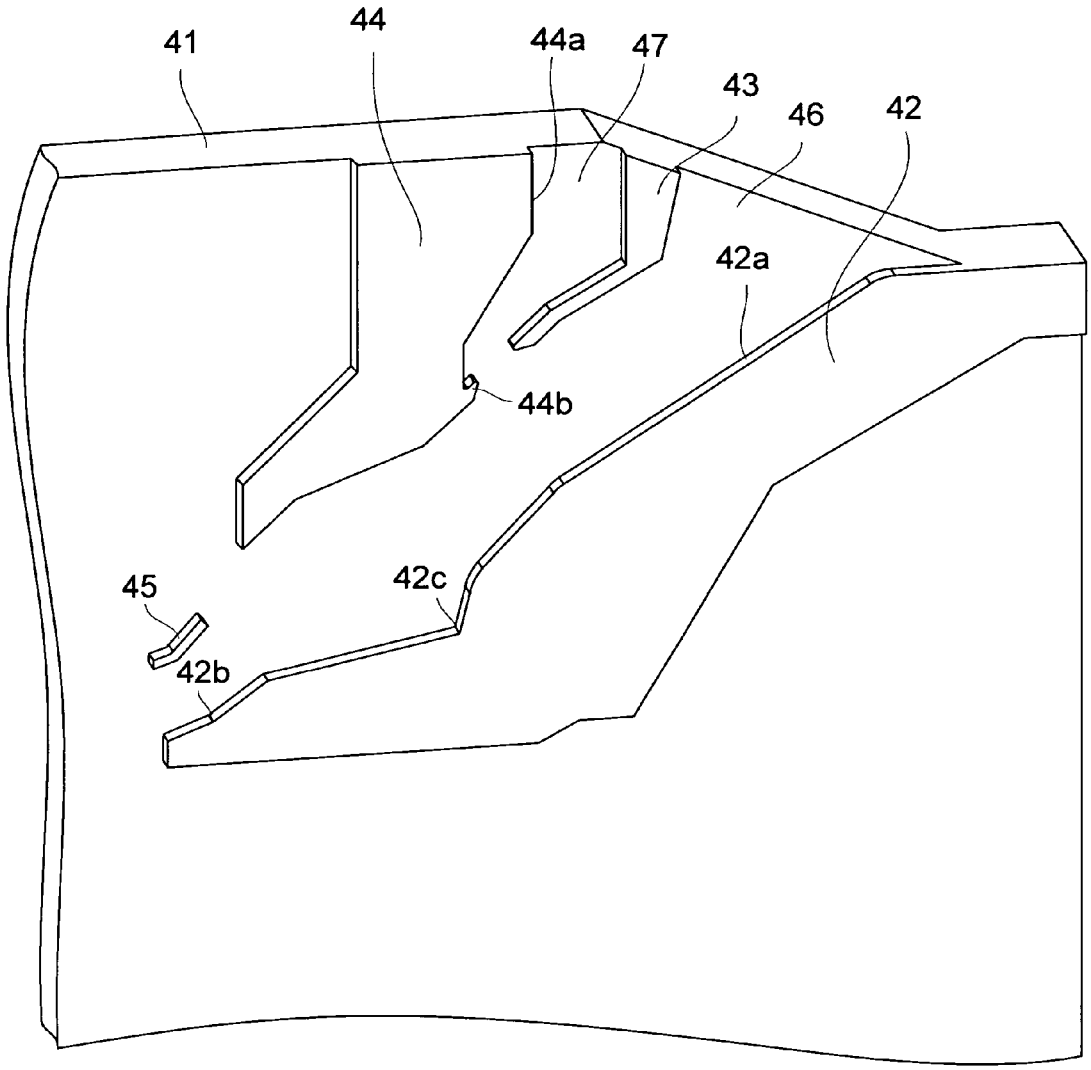
FIG. 7 is a partial perspective view of the mounting wall of the image forming apparatus main body.

Furthermore, as shown in FIG. 7, in the fitting position on a guide face 42*a* of the peninsula-shaped rib 42 where the developing apparatus G is fitted, lock corners 42*b* and 42*c* are formed for positioning the guide projections 27 and 29, respectively, provided in the casing 3. Moreover, in the fitting position on a guide face 44*a* of the peninsula-shaped rib 44 where the developing apparatus G is fitted, a lock projection 44*b* is formed for positioning the guide projection 18*c* provided in the arm 18.

Figure 8A:
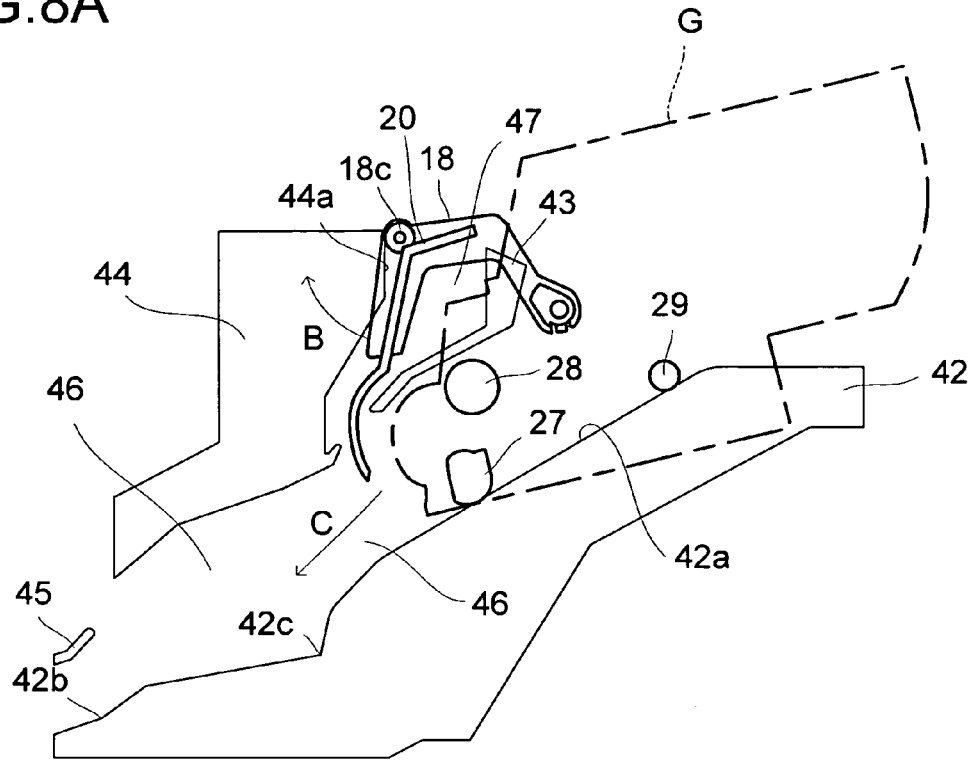
FIG. 8A is a side view showing how a movable portion moves when the developing apparatus is fitted.

Next, a cover member opening and closing mechanism will be described. When the developing apparatus G is fitted to the main body of the image forming apparatus, the developer unit 1 fitted with the toner cartridge 2 is inserted between the mounting walls 40 and 41 as indicated by arrow A shown in FIG. 6. At this time, the guide projections 27, 28, and 29 provided in the casing 3 are made to fit into the first guide recess 46, and the guide projection 18*c* provided in the arm 18 is made to fit into the second guide recess 47. When the developing apparatus G is then further pressed into with the guide projections 27 and 29 of the casing 3 guided along the guide face 42*a*, the guide projection 18*c* of the arm 18 hits a cliff portion of the guide face 44*a* as shown in FIG. 8A, and then the developing apparatus G moves toward the fitting position as indicated by arrow C with the arm 18 swinging as indicated by arrow B. This makes it possible to easily and reliably guide the developing apparatus G to a predetermined fitting position. As the arm 18 swings, the cover member 20 also swings into an opened state.

Figure 8B:
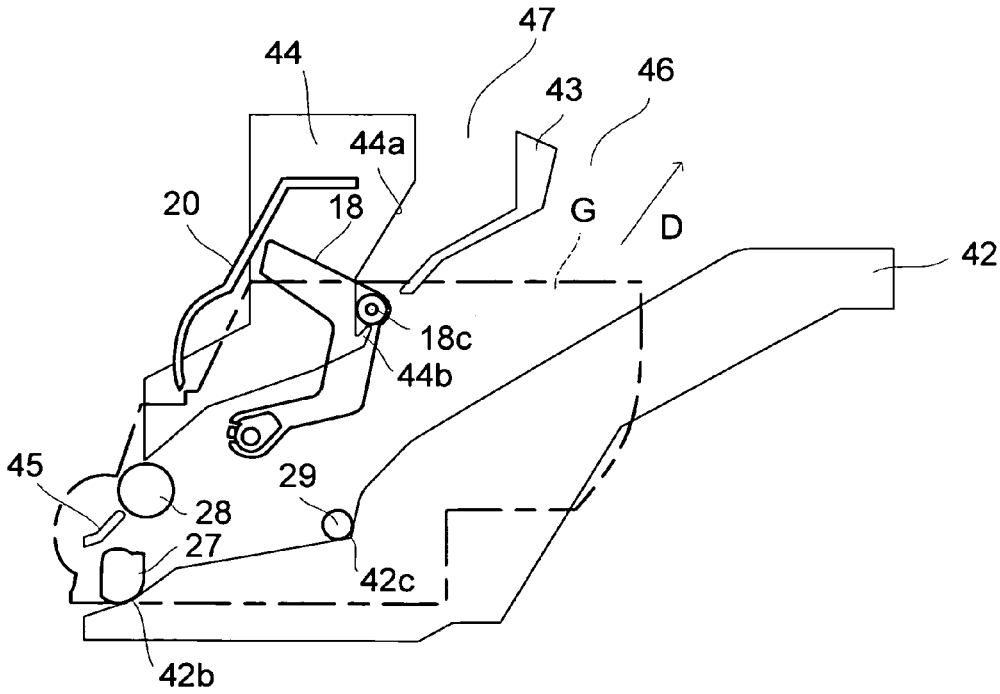
FIG. 8B is a side view showing a state of a movable portion after the developing apparatus has been fitted.

When the developing apparatus G reaches the fitting position, the guide projections 27 and 29 of the casing 3 are positioned in the lock corners 42*b* and 42*c*, respectively, as shown in FIG. 8B, the guide projection 28 of the casing 3 makes contact with the upper edge of the positioning rib 45, and the guide projection 18*c* of the arm 18 makes contact with the guide face 44*a* and the lock projection 44*b* of the peninsula-shaped rib 44. In this way, the developing apparatus G is positioned in place with respect to the fitting direction thereof. It is to be noted that positioning of the developing apparatus G with respect to the direction (longer side direction) perpendicular to the fitting direction thereof is achieved as a result of the outer surfaces of the edge walls 4 and 5 of the casing 3 coming just inside the elevated surfaces of the peninsula-shaped ribs 42, 43, and 44 of the mounting walls 40 and 41.

When the developing apparatus G is detached from the main body 50 of the image forming apparatus, the developing apparatus G is pulled out in the direction indicated by arrow D shown in FIG. 8B with a handle (not shown) or the like provided in the toner cartridge 2. At this time, the arm 18 swings in the direction opposite to arrow B shown in FIG. 8A due to the self-weight of the cover member 20, and the cover member 20 changes into an closed state. Accordingly, when the developing apparatus G is in a state detached from the main body 50, the lever 14*b* is covered with the cover member 20, preventing the lever 14*b* from being inadvertently operated. This makes it possible to prevent the toner cartridge 2 from coming off when the developing apparatus G is carried about.

On the other hand, when the toner cartridge 2 is replaced with a new one, there is no need to detach the developer unit 1 from the image forming apparatus main body 50. By releasing the engagement by operating the lever 14*b* with the developing apparatus G fitted inside the apparatus main body 50, it is possible to detach the toner cartridge 2 alone.

Obviously, many modifications and variations of the present invention are possible in light of the above teachings. It is therefore to be understood that within the scope of the appended claims, the invention may be practiced other than as specifically described. For example, instead of using a cover member of a developing roller as inadvertent operation preventing means for developer container attaching and detaching means, the developer container attaching and detaching means may be covered with an extra member moving relative to the cover member. This description deals with a case where the cover member is provided in a toner cartridge. It should be understood, however, the cover member may be provided in a developer unit.

What is claimed is:

1. A developing apparatus comprising:

developer container attaching and detaching means that makes a developer container attachable to and detachable from a developing device, wherein inadvertent operation preventing means is provided that disables operation of the developer container attaching and detaching means if the developing apparatus is in a state detached from an image forming apparatus main body.

2. The developing apparatus of claim 1, wherein the inadvertent operation preventing means is built as cover means that can be opened and closed and that protects a developing roller rotatably supported inside the developing device, wherein, if the developing apparatus is in a state fitted to the image forming apparatus main body, the cover means is in an opened state so as to make the developing roller and the developer container attaching and detaching means exposed to an outside, and wherein, if the developing apparatus is in a state detached from the image forming apparatus main body, the cover means is in a closed state so as to cover the developing roller and the developer container attaching and detaching means.

3. An image forming apparatus comprising the developing apparatus of claim 2, the image forming apparatus further comprising:

a cover means opening and closing mechanism that causes the cover means to transition from a closed state to an opened state if the developing apparatus is in a state fitted to the image forming apparatus main body, and that causes the cover means to transition from an opened state to a closed state if the developing apparatus is in a state detached from the image forming apparatus main body.

4. A developer container that is detachably fitted to a developing device, the developer container comprising:

inadvertent operation preventing means that disables, if the developing device is in a state detached from an image forming apparatus main body with the developer container fitted thereto, operation of developer container attaching and detaching means that makes the developer container attachable to and detachable from the developing device.

* * * * *